US005785047A

United States Patent [19]

Bird et al.

[11] Patent Number: 5,785,047

[45] Date of Patent: Jul. 28, 1998

[54] COOKTOP OR HOB TOP INCLUDING A PLANAR PANEL INTERLOCKED TO AN OUTBOARD FRAME BY AN INJECTION MOLDED ENCAPSULATION HAVING INJECTION MOLDED ENCAPSULATION HAVING INTEGRAL FASTENERS

[75] Inventors: Kevin Bird, Holland; Lloyd Kaper, Hamilton; Bob Herrmann, Grand Haven; Craig Bienick, Jenison; Gary Reames, Muskegon; Howard Daley; Greg Wolters, both of Zeeland, all of Mich.

[73] Assignee: Gemtrom Corporation, Sweetwater, Tenn.

[21] Appl. No.: 890,651

[22] Filed: Jul. 9, 1997

[51] Int. Cl.[6] ..... F24C 3/00

[52] U.S. Cl. ..... 126/39 H; 219/464; 219/467

[58] Field of Search ..... 219/443, 464, 219/467; 126/39 H, 39 N, 39 J

[56] References Cited

U.S. PATENT DOCUMENTS

| | | |
|---|---|---|
| 4,243,016 | 1/1981 | Kristen et al. . |
| 4,453,533 | 6/1984 | Scheidler et al. . |
| 5,036,831 | 8/1991 | Ray . |
| 5,183,996 | 2/1993 | Hazan et al. . |
| 5,185,047 | 2/1993 | Ray . |
| 5,429,114 | 7/1995 | Taplan et al. . |
| 5,584,957 | 12/1996 | Schultheis et al. . |

*Primary Examiner*—Carroll B. Dority

*Attorney, Agent, or Firm*—Diller, Ramik & Wight, PC

[57] ABSTRACT

A cooktop, hob top or the like includes a cooktop, hob top panel having a peripheral edge portion, a frame bordering the same and a substantially one-piece homogeneous injection molded polymeric/copolymeric encapsulation securing the peripheral edge portion of the panel to the frame. The encapsulation includes integral fasteners adapted to be inserted into openings of a horizontal flange of a range, countertop or the like.

36 Claims, 2 Drawing Sheets

COOKTOP OR HOB TOP INCLUDING A PLANAR PANEL INTERLOCKED TO AN OUTBOARD FRAME BY AN INJECTION MOLDED ENCAPSULATION HAVING INJECTION MOLDED ENCAPSULATION HAVING INTEGRAL FASTENERS

BACKGROUND OF THE INVENTION

The present invention is directed to a cooktop or a hob top which includes a cooktop panel or hob top panel interlockingly secured to an outboard frame by an injection molded polymeric/copolymeric encapsulation. The trim frame preferably rests atop a support surface, and the encapsulation includes a plurality of integral fasteners each received in an opening or bore of a flange of a range, countertop or the like.

Cooktops and hob tops are well known in the art, as evidenced by such patents as U.S. Pat. Nos. 4,243,016; 4,453,533; 5,036,831; 5,183,996; 5,185,047; 5,429,114; 5,584,957 and the various patents cited therein, including Fed. Rep. of Germany (DE 31 10 087). For the most part, these patents disclose a countertop or a range which includes a polygonal opening dimensioned slightly larger than that of a glass-ceramic or equivalent cooktop or hob top panel that is to be mounted therein. A periphery of the range or countertop opening generally includes a down-turned flange with screw holes located at appropriate intervals, typical of which is illustrated in FIG. 1 of U.S. Pat. No. 4,453,533. A silicone seal is bonded to a peripheral edge of the cooktop panel and this silicone seal is bonded to an annular ring of a right-angle cross-sectional configuration, as reflected in U.S. Pat. Nos. 5,185,047 and 5,036,831. A series of screws unite a down-turned leg of the annular ring to a downturned flange of the countertop, range or the like through a series of aligned openings having horizontally disposed axes.

Disadvantages of such typical cooktop/hob top mounting assemblies are set forth in the latter-identified patents and include decreased cleanability, lack of an aesthetically pleasing appearance, the additional expense of providing a separate external trim portion, a complex mounting frame for supporting the glass-ceramic panel, the requirement that the sealing material, sealant or grout material be applied between the glass-ceramic panel and the cooktop after the glass-ceramic panel is installed in the cooktop; the added material and manufacturing expense associated with these aspects of the cooktop; the preapplication of the sealant followed by in-mold curing, etc.

SUMMARY OF THE INVENTION

In keeping with the present invention, a cooktop panel or a hob top panel is inserted into a mold in inboard relationship to a trim ring or trim frame. The mold is contoured to form a peripheral cavity accommodating an innermost peripheral edge of the trim ring and an outermost peripheral edge of the panel. Polymeric/copolymeric material is injected into the cavity and subsequently cools to bond the trim ring to the cooktop panel. The peripheral edge of the cooktop panel can be first primed to achieve maximum adherence between the cooktop panel and the solidified injection molded material or encapsulation, though such is not a requirement of the invention. The trim frame also may include a series of openings with which the encapsulation interlocks upon solidification. Finally, the encapsulation includes integral injection molded fasteners, such as "Christmas tree" plugs, which fasten into openings of a countertop flange or a range flange to unite the cooktop/hob top panel thereto. The latter encapsulation process essentially integrally unites the trim ring and the cooktop panel or hob top panel through the encapsulation with portions of the encapsulation defining integral fasteners for uniting the cooktop/hob top panel to a countertop, range or the like. A cooktop or hob top thus manufactured can be installed absent tools, can be readily removed absent tools, and the overall appearance when associated with a countertop or a range is extremely aesthetic, easily cleaned, and is essentially maintenance free.

DESCRIPTION OF THE PREFERRED EMBODIMENTS

Figure 1:
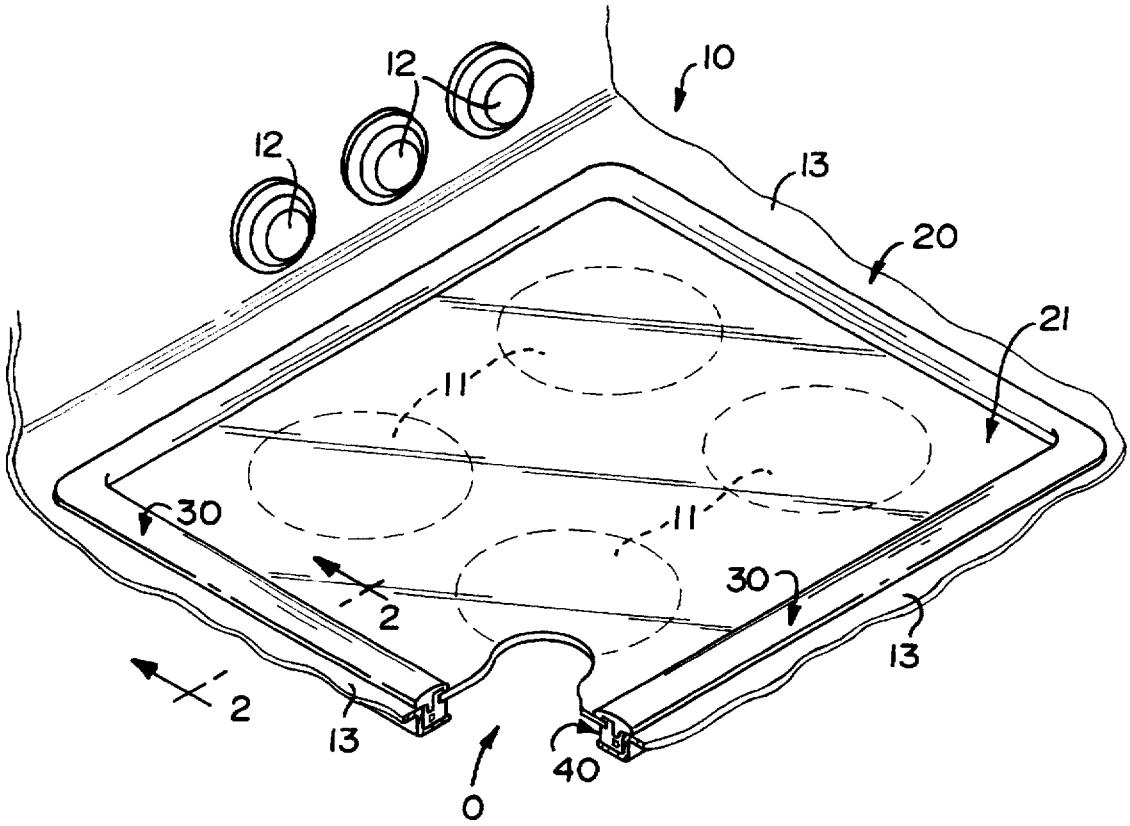
FIG. 1 is a fragmentary perspective view of a novel cooktop, hob top or the like of the present invention, and illustrates a planar polygonal cooktop panel interlockingly united to a peripheral trim ring or frame by an injection molded encapsulation which is in turn fastened to a horizontal flange defining an opening of a range or countertop.

A range 10 of a conventional construction is illustrated in FIG. 1 of the drawings and might instead be, for example, a countertop of the like. The range 10 includes four heating elements 11 and associated controls 12, all of a conventional construction. An upper panel or upper support 13 of the range 10 includes an integral depending wall 14 and a substantially horizontally disposed peripheral edge portion or supporting flange 15 provided with a plurality of circular apertures or openings 16 with an inboardmost terminal edge 17 defining a generally polygonal shaped opening O within and beneath which the heating elements 11 are conventionally mounted.

A cooktop, hob top or the like is generally designated by the reference numeral 20 and includes a substantially planar glass-ceramic panel or plate 21, such as Ceran®. The panel or plate 21 includes an uppermost surface 22, a lowermost surface 23, and an outermost peripheral edge 24 collectively defining an outermost peripheral edge portion 25 of the panel or plate 21.

The cooktop 20 includes an outboard trim ring or trim frame 30 of a generally polygonal configuration having a substantially T-shaped cross-sectional configuration defined by a peripherally outermost arm portion 31, a peripherally innermost arm portion 32 and a substantially vertically depending leg portion 33 having a plurality of bores or openings 34 formed therein. A lowermost surface 35 of the arm portion 31 rests upon the substantially horizontally disposed support 13 while the lower surface 35 of the arm portion 32 rests upon the upper surface 22 of the cooktop panel or plate 21. The surface 35 of the arm portion 32 is recessed to define a downwardly opening peripheral channel 36.

Figure 2:
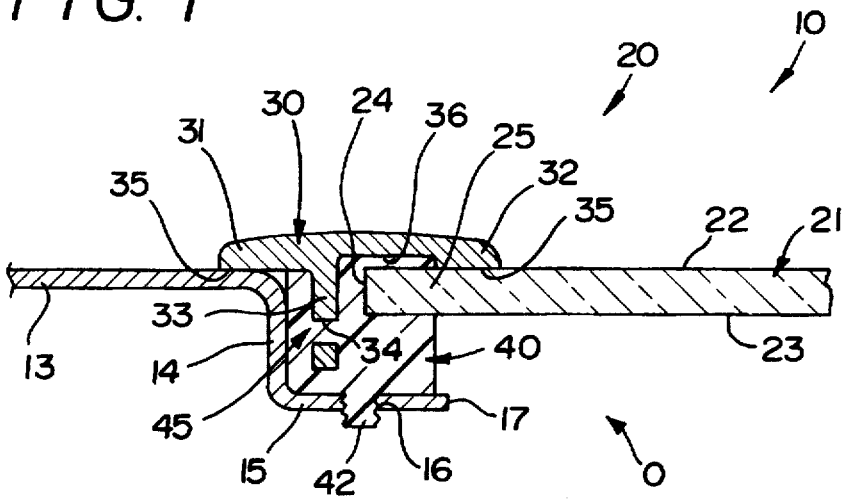
FIG. 2 is an enlarged cross-sectional view taken generally along line 2—2 of FIG. 1, and illustrates details of the encapsulation including one of a plurality of depending "Christmas tree" fasteners interlocked in an opening of a horizontal flange of the range, countertop or like support.

An encapsulation or encapsulation means 40 in the form of a substantially one-piece, homogeneous, injection molded, polymeric/copolymeric material secures the cooktop panel peripheral edge portion 25 of the cooktop 20 to the trim ring or trim frame 30 through an injection molding process similar to that disclosed in U.S. Pat. Nos. 5,441,338; 5,362,145; 5,273,354; 5,403,084; 5,454,638; 5,564,809 and 5,540,493. Essentially, the panel or plate 21 and the trim ring or trim frame 30 are placed in a mold in the relative position illustrated in FIG. 2 with the mold bodies including a cavity (not shown) contoured to form the injection molded encapsulation 40 including integral injection molded attaching means in the form of downwardly projecting "Christmas tree" or like fasteners 42. During the injection molding process, as is self-evident from the latter-identified patents, the polymeric/copolymeric material also flows into the numerous openings or apertures 34 of the depending leg portion 33 of the trim ring 30, solidifies and defines means generally identified by the reference numeral 45 for interlockingly securing the trim ring 30 to the cooktop panel 21 upon the solidification of the encapsulation 40. Preferably, though not necessarily, the surfaces 22, 23 and 24 of the outermost peripheral edge portion 25 of the cooktop panel 21 can have a primer applied thereto as disclosed in the latter patents, such as Chemlok AP-134 one-coat primer and/or Chemlok EP6962-50A/B primer, each manufactured by Lord Corporation, 2000 West Grand View Blvd., P.O. Box 10038, Erie, Pa. 16514-10038. The latter augments the adhesion between the peripheral edge portion 25 of the Ceran® panel 21 and the encapsulation 40 which preferably is Santoprene® manufactured by Advanced Elastomer Systems L.P.

After the encapsulation 40 has solidified, the mold is opened, the cooktop 20 is withdrawn therefrom and shipped to an end user, such as a range manufacturer. Assembly of the cooktop 20 and the associated range 10 is simple and straightforward, namely, the cooktop 20 is aligned with an opening 0 of a range 10, countertop or the like and the projecting integral fasteners 42 are forced downwardly each into one of the openings 16 until the components are fully assembled in the manner illustrated in FIG. 2.

Figure 3:
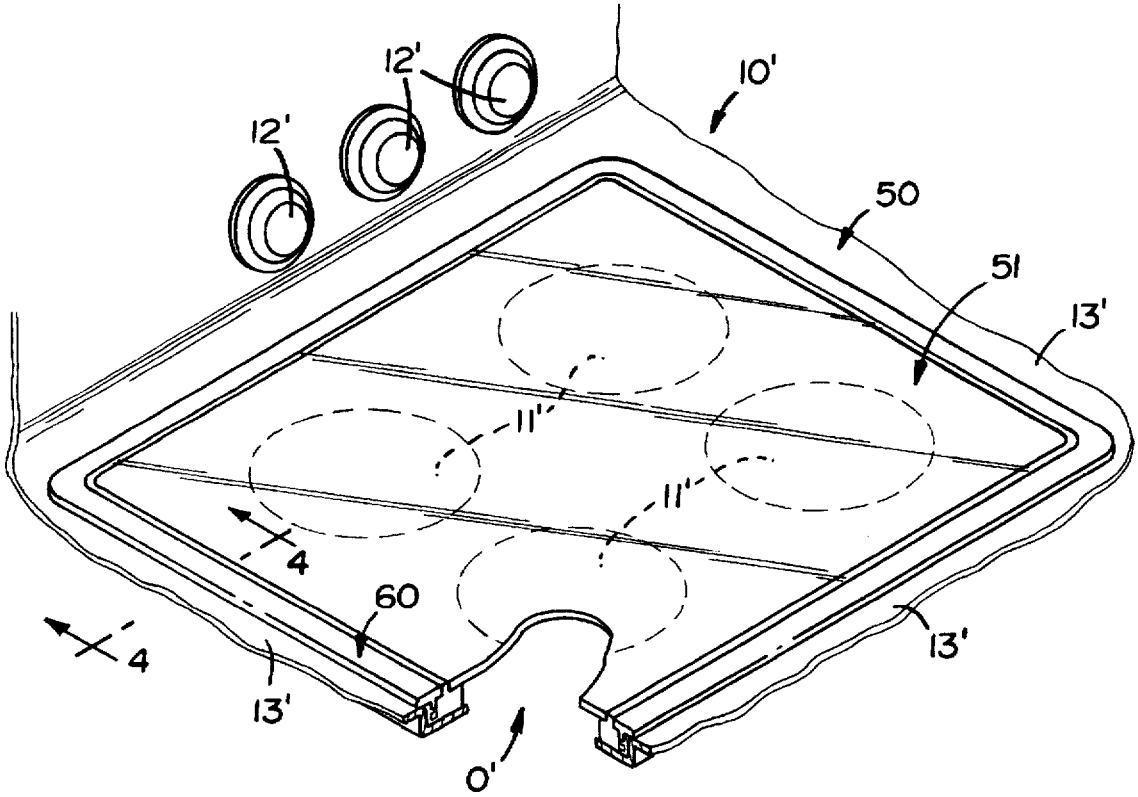
FIG. 3 is a perspective view similar to FIG. 1, but illustrates an encapsulation which includes an upwardly projecting leg sandwiched between opposing peripheral edges of the cooktop panel and the trim ring.

Another range 10' of a conventional construction is illustrated in FIG. 3 of the drawings and might also be a countertop of the like. The range 10' includes four heating elements 11' and associated controls 12', all of a conventional construction. An upper panel or upper support 13' of the range 10' includes an integral depending wall 14' and a substantially horizontally disposed peripheral edge portion or supporting flange 15' provided with a plurality of circular apertures or openings 16' with an inboardmost terminal edge 17' defining a generally polygonal shaped opening O' within and beneath which the heating elements 11' are conventionally mounted.

A cooktop, hob top or the like is generally designated by the reference numeral 50 and includes a substantially planar glass-ceramic panel or plate 51, such as Ceran®. The panel or plate 51 includes an uppermost surface 52, a lowermost surface 53, and an outermost peripheral edge 54 collectively defining an outermost peripheral edge portion 55 of the panel or plate 51.

The cooktop 50 includes an outboard trim ring or trim frame 60 of a generally polygonal configuration having a substantially T-shaped cross-sectional configuration defined by a peripherally outermost arm portion 61, a peripherally innermost short arm portion 62 and a substantially vertically depending leg portion 63 having a plurality of bores or openings 64 formed therein. A lowermost surface 65 of the arm portion 61 rests upon the substantially horizontally disposed support 13' while the lower surface 65 of the arm portion 62 rests upon an upper surface (unnumbered) of an encapsulation 70. The arm portion 62 of the trim ring 60 is spaced from the edge 54 of the cooktop panel 51 to define a peripheral gap 80.

Figure 4:
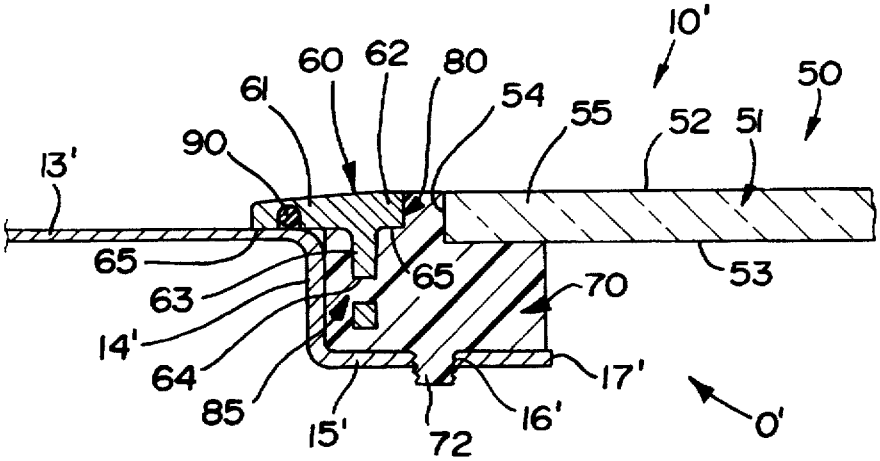
FIG. 4 is an enlarged cross-sectional view taken generally along line 4—4 of FIG. 3, and illustrates specific details of the encapsulation and an O-ring carried by the trim ring.

The encapsulation or encapsulation means 70 is a substantially one-piece, homogeneous, injection molded, polymeric/copolymeric material which secures the cooktop panel peripheral edge portion 55 of the cooktop 50 to the trim ring or trim frame 60 through an injection molding process similar to that disclosed in the latter-identified patents. Essentially, the panel or plate 51 and the trim ring or trim frame 60 are placed in a mold in the relative position illustrated in FIG. 4 with the mold bodies including a cavity (not shown) contoured to form the injection molded encapsulation 70 including integral injection molded attaching means in the form of downwardly projecting "Christmas tree" or like fasteners 72. During the injection molding process, as is self-evident from the latter-identified patents, the polymeric/copolymeric material also flows into the numerous openings or apertures 64 of the depending leg portion 63 of the trim ring 60, solidifies and defines means generally identified by the reference numeral 85 for interlockingly securing the trim ring 60 to the cooktop panel 51 upon the solidification of the encapsulation 70. During the injection molding process, the polymeric/copolymeric material flows into the gap 80 and also solidifies therein. The portion of the encapsulation 70 in the gap 80 defines an uppermost surface (unnumbered) forming a smooth substantially coplanar transition in and between uppermost surfaces (unnumbered) of the cooktop panel 51 and the short arm portion 62 of the trim ring 60. Preferably, though not necessarily, the surfaces 52, 53, and 54 of the outermost peripheral edge portion 55 of the cooktop panel 51 can have a primer applied thereto, as disclosed in the latter patents, such as Chemlok AP-134 one-coat primer and/or Chemlok EP6962-50A/B primer, each manufactured by Lord Corporation, 2000 West Grand View Boulevard, P.O. Box 10038, Erie, Pa. 16514-10038. The latter augments the adhesion between the peripheral edge portion 55 of the Ceran® panel 51 and the encapsulation 70 which preferably is Santoprene® manufactured by Advanced Elastomer Systems L.P.

The arm portion 61 of the trim ring 60 includes a channel (unnumbered) which opens through the surface 65 and receives an O-ring seal or sealing means 90 for sealing against an upper surface (unnumbered) of the support 13'.

After the encapsulation 70 has solidified, the mold is opened, the cooktop 50 is withdrawn therefrom and shipped to an end user, such as a range manufacturer. Assembly of the cooktop 50 and the associated range 10' is simple and straightforward, namely, the cooktop 50 is aligned with the opening O' of a range 10', countertop or the like and the projecting integral fasteners 72 are forced downwardly each into one of the openings 16' until the components are fully assembled in the manner illustrated in FIG. 4.

What is claimed is:

1. A cooktop, hob top or the like comprising a cooktop panel having a peripheral edge portion, a frame substantially bordering said peripheral edge portion, substantially one-piece homogeneous injection molded polymeric/copolymeric encapsulation means for peripherally encapsulating and securing said peripheral edge portion to said frame, and said injection molded encapsulating means includes integral injection molded attaching means for attaching said cooktop to an associated support.

2. The cooktop, hob top or the like as defined in claim 1 wherein said injection molded peripheral encapsulation securing means includes means for interlockingly uniting said peripheral edge portion to said frame.

3. The cooktop, hob top or the like as defined in claim 1 wherein said integral injection molded attaching means depends substantially normal to a plane through said cooktop panel.

4. The cooktop, hob top or the like as defined in claim 1 including means between said cooktop panel peripheral edge portion and said peripheral securing means for bondingly adhering said cooktop panel peripheral edge portion and said peripheral securing means to each other.

5. The cooktop, hob top or the like as defined in claim 1 wherein said integral injection molded attaching means includes a plurality of spaced projecting fasteners for fastening said cooktop to a support.

6. The cooktop, hob top or the like as defined in claim 1 wherein said integral injection molded attaching means includes a plurality of spaced projecting fasteners for fastening said cooktop to a horizontal support.

7. The cooktop, hob top or the like as defined in claim 1 wherein said integral injection molded attaching means includes a plurality of spaced projecting fasteners for fastening said cooktop to a plurality of openings in a horizontal support.

8. The cooktop, hob top or the like as defined in claim 1 wherein said integral injection molded attaching means includes a plurality of spaced projecting fasteners for fastening said cooktop to a plurality of openings in a horizontal support flange.

9. The cooktop, hob top or the like as defined in claim 1 including a peripheral seal carried by said frame for sealing against an underlying support surface.

10. The cooktop, hob top or the like as defined in claim 1 wherein said frame includes a vertical leg having a plurality of openings therein, and said injection molded peripheral securing means is in embracing relationship to said leg and in spanning relationship through said plurality of openings.

11. The cooktop, hob top or the like as defined in claim 1 wherein said injection molded peripheral securing means includes a peripheral leg portion sandwiched between an outermost peripheral edge of said cooktop panel peripheral edge portion and a peripheral surface of said frame.

12. The cooktop, hob top or the like as defined in claim 1 wherein said injection molded peripheral securing means includes a peripheral leg portion sandwiched between an outermost peripheral edge of said cooktop panel peripheral edge portion and an innermost peripheral edge of said frame.

13. The cooktop, hob top or the like as defined in claim 1 wherein said cooktop panel peripheral edge portion, frame and peripheral securing means each have an uppermost surface, and said uppermost surfaces collectively define a substantially smooth uppermost surface of said cooktop.

14. The cooktop, hob top or the like as defined in claim 2 including means between said cooktop panel peripheral edge portion and said peripheral securing means for bondingly adhering said cooktop panel peripheral edge portion and said peripheral securing means to each other.

15. The cooktop, hob top or the like as defined in claim 2 wherein said integral injection molded attaching means includes a plurality of spaced projecting fasteners for fastening said cooktop to a support.

16. The cooktop, hob top or the like as defined in claim 2 wherein said integral injection molded attaching means includes a plurality of spaced projecting fasteners for fastening said cooktop to a horizontal support.

17. The cooktop, hob top or the like as defined in claim 2 wherein said frame includes a vertical leg having a plurality of openings therein, and said injection molded peripheral securing means is n embracing relationship to said leg and in spanning relationship through said plurality of openings.

18. The cooktop, hob top or the like as defined in claim 2 wherein said injection molded peripheral securing means includes a peripheral leg portion sandwiched between an outermost peripheral edge of said cooktop panel peripheral edge portion and an innermost peripheral edge of said frame.

19. The cooktop, hob top or the like as defined in claim 2 wherein said cooktop panel peripheral edge portion, frame and peripheral securing means each have an uppermost surface, and said uppermost surfaces collectively define a substantially smooth uppermost surface of said cooktop.

20. The cooktop, hob top or the like as defined in claim 2 wherein said integral injection molded attaching means depends substantially normal to a plane through said cooktop panel.

21. The cooktop, hob top or the like as defined in claim 20 including means between said cooktop panel peripheral edge portion and said peripheral securing means for bondingly adhering said cooktop panel peripheral edge portion and said peripheral securing means to each other.

22. The cooktop, hob top or the like as defined in claim 20 wherein said integral injection molded attaching means includes a plurality of spaced projecting fasteners for fastening said cooktop to a support.

23. The cooktop, hob top or the like as defined in claim 21 wherein said integral injection molded attaching means includes a plurality of spaced projecting fasteners for fastening said cooktop to a support.

24. The cooktop, hob top or the like as defined in claim 23 including a peripheral seal carried by said frame for sealing against an underlying support surface.

25. A cooktop, hob top or like assembly comprising a substantially planar top panel and a top panel support; said top panel support including a substantially peripheral edge portion defining an opening; said top panel including a peripheral edge portion, a frame substantially bordering said top panel peripheral edge portion, substantially one-piece homogeneous injection molded polymeric/copolymeric encapsulation means for peripherally encapsulating and securing said top panel peripheral edge portion to said frame; said top panel being disposed in generally overlying relationship to said opening, and said injection molded encapsulation securing means includes integral injection molded attaching means for attaching said top panel to said top panel support peripheral edge portion.

26. The cooktop, hob top or like assembly as defined in claim 25 wherein said top panel support peripheral edge portion is disposed substantially horizontally.

27. The cooktop, hob top or like assembly as defined in claim 25 wherein said top panel support peripheral edge portion is a substantially horizontally disposed flange.

28. The cooktop, hob top or like assembly as defined in claim 25 wherein said top panel support peripheral edge portion is defined by an outboardmost substantially horizontally disposed portion blending into an offset medial portion blending into an inboardmost substantially horizontally disposed flange defining said opening.

29. The cooktop, hob top or like assembly as defined in claim 25 wherein said top panel support peripheral edge portion is defined by an outboardmost substantially horizontally disposed portion blending into an offset medial portion blending into an inboardmost substantially horizontally disposed flange defining said opening, and said flange supports said top panel through said encapsulation means.

30. The cooktop, hob top or like assembly as defined in claim 25 wherein said top panel support peripheral edge portion is defined by an outboardmost substantially horizontally disposed portion blending into an offset medial portion blending into an inboardmost substantially horizontally disposed flange defining said opening, and said injection molded peripheral encapsulation securing means rests upon said flange.

31. The cooktop, hob top or like assembly as defined in claim 25 wherein said injection molded attaching means include a plurality of spaced projecting fasteners for fastening said injection molded peripheral encapsulation securing means to said top panel support peripheral edge portion.

32. The cooktop, hob top or like assembly as defined in claim 25 wherein said injection molded attaching means include a plurality of spaced projecting fasteners each fastened in an aperture of said top panel support peripheral edge portion for fastening said injection molded peripheral encapsulation securing means to said top panel support peripheral edge.

33. The cooktop, hob top or like assembly as defined in claim 32 wherein said top panel support peripheral edge portion is defined by an outermost substantially horizontally disposed portion blending into an offset medial portion blending into an innermost flange defining said opening and having said apertures therein.

34. The cooktop, hob top or like assembly as defined in claim 33 wherein said injection molded peripheral encapsulation securing means includes means for interlockingly uniting said injection molded peripheral encapsulation securing means to said frame.

35. The cooktop, hob top or like assembly as defined in claim 33 wherein said injection molded peripheral encapsulation securing means includes means for interlockingly uniting said injection molded peripheral encapsulation securing means to a leg of said frame.

36. The cooktop, hob top or like assembly as defined in claim 33 wherein said injection molded peripheral encapsulation securing means includes means for interlockingly uniting said injection molded peripheral encapsulation securing means to openings in a leg of said frame.

* * * * *